United States Patent [19]

Hennigan

[11] Patent Number: 4,909,003

[45] Date of Patent: Mar. 20, 1990

[54] SOUND INSULATING SPACE BOARD

[76] Inventor: Michael R. Hennigan, 7670 Chelsea Pl., Beaumont, Tex. 77706

[21] Appl. No.: 218,791

[22] Filed: Jul. 14, 1988

[51] Int. Cl.[4] ..... E04B 1/82

[52] U.S. Cl. ..... 52/144; 52/404; 52/630

[58] Field of Search ..... 52/404, 406, 407, 232, 52/450, 451, 630, 743, 806, 808, 809, 144

[56] References Cited

U.S. PATENT DOCUMENTS

| | | | |
|---|---|---|---|
| 2,545,805 | 3/1951 | Callender | 52/404 X |
| 2,771,164 | 11/1956 | Scurlock | 52/630 X |
| 2,786,004 | 3/1957 | Schwartz et al. | 154/45 |
| 2,954,838 | 10/1960 | Nuorivaara | 52/144 X |
| 3,068,956 | 12/1962 | Cooley | 52/144 X |
| 3,314,846 | 4/1967 | Niwa | 161/69 |
| 3,769,770 | 11/1973 | Deschamps et al. | 52/404 |
| 4,045,931 | 9/1977 | Becker . | |
| 4,155,208 | 5/1979 | Shanabarger | 52/406 |
| 4,214,418 | 7/1980 | Smith | 53/452 |
| 4,247,583 | 1/1981 | Roy | 52/406 X |
| 4,405,931 | 9/1984 | Becker | 52/406 |

FOREIGN PATENT DOCUMENTS

| | | | |
|---|---|---|---|
| 751932 | 7/1980 | U.S.S.R. | 52/806 |
| 1317074 | 6/1987 | U.S.S.R. | 52/806 |

*Primary Examiner*—David A. Scherbel
*Assistant Examiner*—Creighton Smith
*Attorney, Agent, or Firm*—Henderson & Sturm

[57] ABSTRACT

A sound insulating space board apparatus (10) comprising an evacuated cellular array (14) sealingly engaged to an upper (18) and lower (19) planar member, wherein each of the planar members are provided with a layer of air impervious material (100), and each of the individual evacuated cells (15) in the cellular array (14) define a nine sided polyhedron configuration.

7 Claims, 1 Drawing Sheet

SOUND INSULATING SPACE BOARD

TECHNICAL FIELD

This invention relates generally to the field of sound insulating building panels.

BACKGROUND OF THE INVENTION

While thermal insulation is a primary concern in the construction of most new residential and commercial buildings, very little thought is given to the sound proofing of these structures; either from the standpoint of insulating the interior of th building from the surrounding ambient noise; or from the standpoint of confining internally generated noise within a limited area.

In as much as the external wall thickness of most modern buildings act as a buffer against sound propagation, coupled with the widespread use of sealed windows having a vacuum chamber that provides thermal as well as acoustical insulation, most modern buildings have an inherent external sound insulation consideration factored into their construction.

With respect to internally propagated sound, most modern constructions rely on carpet and acoustical ceiling tiles to compensate for normal noise levels encountered in most homes and offices. In instances wherein abnormally high decibel levels are present, which is usually only found in a commercial environment, specialized constructions must be employed to acoustically isolate the source of the noise.

The aforementioned specialized constructions are very expensive to fabricate and require precision installation to maintain the integrity of the particular acoustical barrier employed. Obviously this type of an acoustical barrier would be neither practical nor desirable for widespread residential use on a cost versus benefit standpoint.

Anyone who has lived in an apartment, having a common wall between the adjacent dwellings, is well aware of the noise pollution that can be transmitted through these membranes which act as sound boards. The same situation exists with the internal room partitions found in most single family detached homes, whereby sound is readily transmitted through the walls in an identical manner.

Up until the present invention was developed, there had not been available a low cost acoustical building panel that: would substantially reduce the noise levels transmitted therethrough; and, which could be employed as the primary partition surface; or, as an auxiliary partition surface, to define a sound inhibiting chamber.

BRIEF SUMMARY OF THE INVENTION

The present invention involves a sound insulating space board comprising an evacuated cellular array sandwiched between two air impervious layers, wherein the cellular array forms spaced, off-set contact surfaces on the respective layers to reduce substantially the sound transmitting capability of the planar layer surfaces. In addition the evacuated cells of the cellular array, restrict the propagation of sound other than through the walls of the cells, to further enhance the sound dampening characteristics of the space board.

Briefly stated the present invention comprises a recriprocal cellular array sandwiched between two outer planar surfaces; wherein opposed sides of the cellular array defined discrete sound insulating chambers between the respective planar surfaces. In addition the sound transmitting points of contact between the cellular array and either of the planar surfaces represents only a small fraction of the total potential sound transmitting surface area of the respective planar surfaces taken either alone or in combination.

In addition the present invention contemplates the use of the sound insulating space board as either a primary structural component or an auxiliary structural component that can be added to existing wall partitions. In either instance the individual cells of the cellular array are acoustically isolated from one another, whereby the penetration of one or more individual cells will not destroy the sound barrier integrity of the surrounding cells in the cellular array.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings wherein.

BEST MODE FOR CARRYING OUT THE INVENTION

Figure 1:
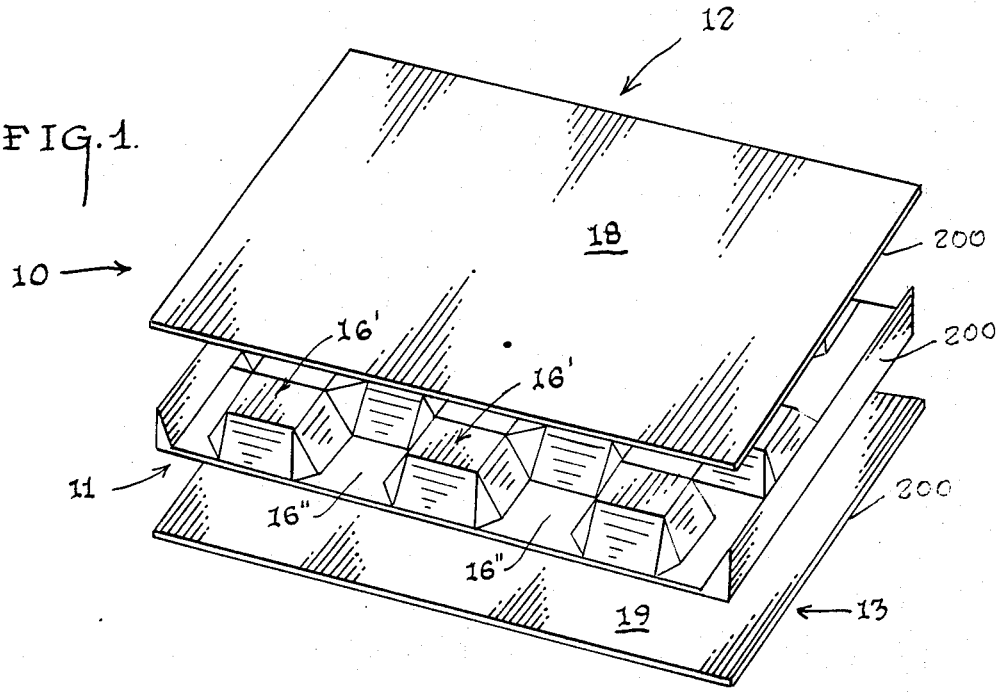
FIG. 1 is an exploded perspective view of the sound insulating space board apparatus of the invention.

As can be seen by reference to the drawings and in particular to FIG. 1, the sound insulating space board apparatus of the present invention is designated generally by the reference numeral (10). The apparatus (10) comprises in general a cellular array unit (11) sandwiched between two planar surface units (12) and (13). These units will now be described in seriatim fashion.

The cellular array unit (11) comprises a reciprocal array (14) of integral formed individual cells (15); wherein, each individual cell (15) has a nine sided polyhedron configuration.

Figure 3:
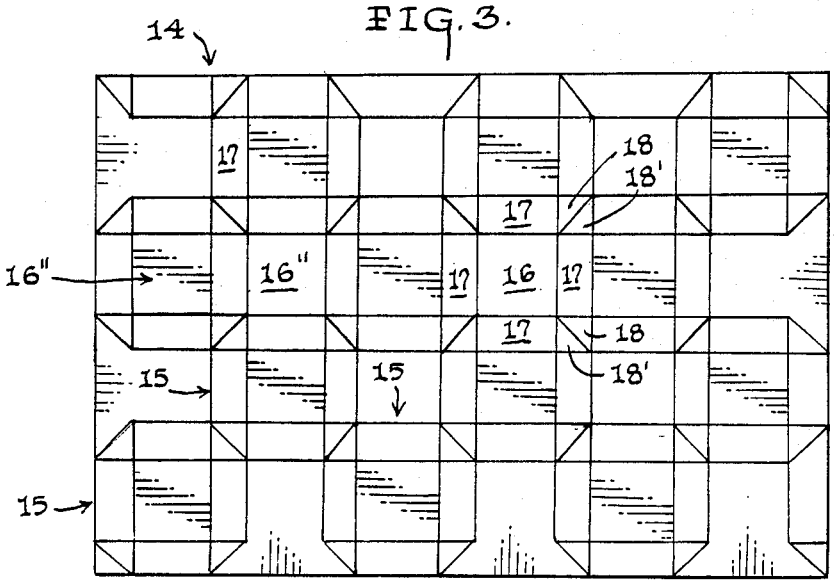

As can best be seen by reference to FIG. 3, each individual cell (15) is provided with a generally square center panel (16) having four generally rectangular side panels (17) extending outwardly from the sides of the center panel (16) and pairs of diagonally opposed complementary triangular panels (18) (18') extending from each corner of the center panel (16).

Each of the individual cells (15) of the cellular array (14) forms a portion of the adjacent reciprocal cell (15), with the exception of the center panels (16), as will be explained shortly.

The easiest way to appreciate the cellular array (14) of the present invention is to visualize a waffle iron construction wherein the lands and recesses of the waffle iron surface are formed from a flat sheet of stock material. As best seen in FIGS. 1 and 3, the lands are designated as 16' and the recesses are designated as 16'.

The reciprocal arrangement of the adjacent individual cells (15) disposes inverted cells in a side by side relationship with a given cell; and, disposes similar cells in a diagonal relationship with a given cell.

Figure 2:
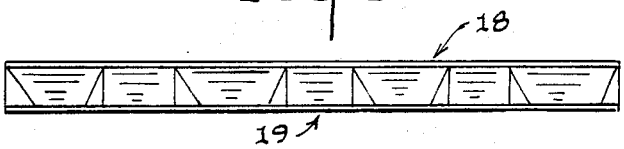
FIG. 2 is an enlarged cross-sectional side elevational view of the apparatus; and, FIG. 3 is a top plan view of the cellular array and one of the planar surfaces of the apparatus.
Figure 4:
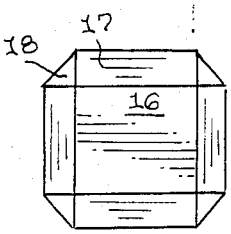

As can best be seen by reference to FIGS. 1 and 2, the planar surface units (12) and (13) comprise upper (18) and lower (19) planar members that are sealingly secured to the lands (16') and recesses (16'') respectively of the cellular array (14) to create acoustical chambers from each of the individual reciprocal cells (15).

In as much as the stated purpose of this invention is to provide an acoustical barrin to the transmission of sound through the space board apparatus (10); the structure described to this point accomplishes a substantial portion of that goal; in that the surface area of the respective planar members (18) and (19) capable of receiving and/or transmitting sound vibrations has been substantially reduced, by the spaced contact of the lands and recesses relative to the individual planar members.

Given the fact that sound vibrations cannot be transmitted through a vacuum, this invention contemplates at least a partial evacuation of the space defined by the planar members (18) and (19). To accomplish this objective it will be necessary to assemble the space board apparatus (10) of this invention in a vacuum chamber (not shown). Prior to assembly; however, it will be necessary to insure the air tight integrity of the individual cells to the greatest extent possible.

In order to accomplish this last stated objective, it will be necessary to cover the interior surfaces of the planar members (18) and (19) and both sides of the cellular array (14) with layers of air impervious material (100) such as metal foil, mylar, or the like. It also will be necessary to subsequently bond the contracting surfaces of the cellular array (14) and the upper and lower planar members (18) and (19), while in the vacuum chamber, to effect the acoustical chamber integrity of the individual cells (15).

As can best be seen by reference to FIG. 3, the acoustical chambers (15') formed by the individual reciprocal cells (15) are defined by the layers of air impervious material (100) on the lower surface (18') of the upper planar member (18), the upper surface (19') of the lower planar member (19), and both sides (14') and (14'') of the cellular array (14).

It should also be appreciated at this juncture that the use of the layers of air impervious material is only necessary in instances; wherein the structural elements (200) such as cardboard, rigid paper, or the like, used to form the upper and lower planar surfaces (18) and (19) and the cellular array (14) are themselves air permeable, and would not hold a vacuum within the individual cells. Obviously, if the structural elements (200) are themselves air impervious as in the case of metals, and plastic, it would not be necessary to provide additional layers of air impervious material in order to practice this invention.

However, in the preferred embodiment of this invention, the space board apparatus (10) was developed to accommodate low cost mass production techniques; and, to that end the structural elements (200) employed in the fabrication of the space board apparatus (10) comprise severable, air permeable materials (200') such as cardboard, fiberboard, or the like. These materials (200') are lightweight, readily available, inexpensive, and easily conformed to the desired configurations necessary to practice this invention.

In closing it should also be noted that a space board apparatus (10) constructed in accordance with the teachings of this invention will provide a low cost sound insulating panel that may be used: as a primary wall partition; or, as an auxiliary wall partition, that can be used as a covering for existing wall partitions. It should further be noted that the apparatus (10) of the preferred embodiment by virtue of the use of air permeable severable materials (200') may be easily cut to fit virtually any wall partition dimension or configuration.

In addition by virtue of the sealed integrity of the individual cells (15) the space board apparatus (10) may be penetrated by nails, staples, etc. in the standard manner of securing all partitions, while still maintaining the sound insulating characteristics of the unpenetrated cells (15) in the array (14).

Having thereby described the subject matter of this invention, it should be obvious that many substitutions, modifications and variations of the invention are possible in light of the above teachings. It is therefore to be understood that the invention as taught and described herein is only to be limited to the extent of the breadth and scope of the appended claims.

I claim:

1. A sound insulating space board apparatus comprising:
   - an upper planar member provided with a layer of air impervious material on its lower surface;
   - a lower planar member provided with a layer of air impervious material on its upper surface; and,
   - a cellular array sandwiched between the air impervious material on said upper and lower planar members; wherein the upper and lower surfaces of said cellular array are covered with layers of air impervious material and the cellular array comprises a plurality of reciprocal integral cells comprising like cells and unlike cells wherein each cell has a nine sided polyhedron configuration.

2. A space board apparatus as in claim 1 wherein the like cells are disposed diagonally with respect to adjacent like cells, and are disposed side to side with respect to adjacent unlike cells.

3. A space board apparatus as in claim 1 wherein both sides of said cellular area are covered with a layer of air impervious material.

4. A space board apparatus as in claim 1 wherein the cellular array is sealingly engaged with the upper and power planar members and the individual cells of the cellular array are evacuated.

5. A sound insulating space board apparatus comprising:
   - an upper planar member comprising at least one layer of air impervious material;
   - a lower planar member comprising at least one layer of air impervious material; and,
   - a cellular array sandwiched between said upper and lower planar members and comprising at least one layer of air impervious material; wherein, the cellular array comprises: a plurality of individual cells wherein each cell has a nine sided polyhedron configuration.

6. A space board apparatus as in claim 5 wherein adjacent cells are arranged in a reciprocal fashion with respect to one another.

7. A space board apparatus as in claim 6 wherein the individual cells are evacuated and sealingly engaged relative to said upper and lower planar members.

* * * * *